US007320851B2

(12) United States Patent
Zhou et al.

(10) Patent No.: US 7,320,851 B2
(45) Date of Patent: Jan. 22, 2008

(54) TONER PARTICLES AND METHODS OF PREPARING THE SAME

(75) Inventors: Ke Zhou, Mississauga (CA); Enno Eric Agur, Toronto (CA); Wafa Faisul Bashir, Mississauga (CA); Maria N. V. McDougall, Burlington (CA); Emily Louise Moore, Mississauga (CA); Shigang Steven Qiu, Toronto (CA); Vladislav Skorokhod, Mississauga (CA); Daryl W. Vanbesien, Burlington (CA); Edward Graham Zwartz, Mississauga (CA); Joseph August Bartel, Dublin, CA (US); Patricia Ann Burns, Milton (CA); T. Brian McAneney, Burlington (CA); Richard P. N. Veregin, Mississauga (CA); Paul Joseph Gerroir, Oakville (CA)

(73) Assignee: Xerox Corporation, Norwalk, CT (US)

( * ) Notice: Subject to any disclaimer, the term of this patent is extended or adjusted under 35 U.S.C. 154(b) by 550 days.

(21) Appl. No.: 11/034,111

(22) Filed: Jan. 13, 2005

(65) Prior Publication Data

US 2006/0154162 A1 Jul. 13, 2006

(51) Int. Cl.
*G03G 9/08* (2006.01)
*G03G 9/087* (2006.01)

(52) U.S. Cl. ..... 430/110.2; 430/137.14; 430/137.2

(58) Field of Classification Search ..... 430/110.2, 430/137.14, 137.2
See application file for complete search history.

(56) References Cited

U.S. PATENT DOCUMENTS

| | | | |
|---|---|---|---|
| 3,590,000 | A | 6/1971 | Palermiti et al. |
| 3,655,374 | A | 4/1972 | Palermiti et al. |
| 3,674,736 | A | 7/1972 | Lerman et al. |
| 3,720,617 | A | 3/1973 | Chatterji et al. |
| 3,800,588 | A | 4/1974 | Larson et al. |
| 3,944,493 | A | 3/1976 | Jadwin et al. |
| 3,983,045 | A | 9/1976 | Jugle et al. |
| 4,007,293 | A | 2/1977 | Mincer et al. |
| 4,079,014 | A | 3/1978 | Burness et al. |
| 4,254,201 | A | 3/1981 | Sawai et al. |
| 4,394,430 | A | 7/1983 | Jadwin et al. |
| 4,560,635 | A | 12/1985 | Hoffend et al. |
| 4,702,989 | A | 10/1987 | Sugiyama et al. |
| 4,789,617 | A | 12/1988 | Arahara et al. |
| 4,935,326 | A | 6/1990 | Creatura et al. |
| 4,937,166 | A | 6/1990 | Creatura et al. |
| 5,037,716 | A | 8/1991 | Moffat |
| 5,278,020 | A | 1/1994 | Grushkin et al. |
| 5,290,654 | A | 3/1994 | Sacripante et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,482,812 | A | 1/1996 | Hopper et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,593,807 | A | 1/1997 | Sacripante et al. |
| 5,650,255 | A | 7/1997 | Ng et al. |
| 5,650,256 | A | 7/1997 | Veregin et al. |
| 5,688,325 | A | 11/1997 | Aidum |
| 5,945,245 | A | 8/1999 | Mychajlowskij et al. |
| 5,994,020 | A | 11/1999 | Patel et al. |
| 6,207,339 | B1 | 3/2001 | Kato et al. |
| 6,210,853 | B1 | 4/2001 | Patel et al. |
| 6,294,606 | B1 | 9/2001 | Chen et al. |
| 6,582,873 | B2 | 6/2003 | Jiang et al. |
| 6,617,092 | B1 * | 9/2003 | Patel et al. ..... 430/137.14 |
| 6,627,373 | B1 * | 9/2003 | Patel et al. ..... 430/137.14 |
| 6,656,658 | B2 * | 12/2003 | Patel et al. ..... 430/137.14 |

FOREIGN PATENT DOCUMENTS

| | | |
|---|---|---|
| WO | WO 94/11446 | 5/1994 |

* cited by examiner

*Primary Examiner*—Hoa Van Le
(74) *Attorney, Agent, or Firm*—Oliff & Berridge, PLC

(57) ABSTRACT

Toner particles comprise resin, wax and optionally colorants, and the wax is substantially excluded from the interior core of the toner particles. Processes for preparing such toner particles comprise providing an aqueous dispersion of resin particles and optionally colorants, mixing the aqueous dispersion in presence of a coagulant, aggregating to form particles, coalescing to form fused particles, and removing the fused particles from the aqueous dispersion. Wax dispersions can be added either after mixing or during aggregation, so that wax is excluded from the core of the toner particles.

25 Claims, No Drawings

TONER PARTICLES AND METHODS OF PREPARING THE SAME

BACKGROUND

Numerous processes are known for the preparation of toners, such as, for example, emulsion aggregation processes. Such toner preparation processes are illustrated in a number of patents, such as U.S. Pat. Nos. 5,290,654, 5,278,020, 5,308,734, 5,370,963, 5,344,738, 5,403,693, 5,418,108, 5,364,729, 5,346,797, 5,348,832, 5,405,728, 5,366,841, 5,496,676, 5,527,658, 5,585,215, 5,593,807, 5,650,255, 5,650,256, 5,501,935, 5,945,245 and 6,582,873, the disclosures of which are incorporated herein by reference in their entirety. In these methods, the toners are formed chemically in situ and do not require known pulverization and/or classification methods.

Waxes are added to toner formulations in order to aid toner release from the fuser roll during fusing, particularly in low oil or oil-less fuser designs, and to help release of the fused image document from the fuser roll. That is, waxes are added to prevent the fused image document from curling around the fuser roll. In addition, waxes are added to the toner formulations in order to reduce the occurrence of stripper finger marks, such as scratch marks, changes in image gloss and the like, on the fused images, where stripper fingers aid the removal of fused image documents from fuser roll. Furthermore, waxes in toner formulations aid in the prevention of document offset where fused images on documents in contact over a prolonged period of time or at elevated temperatures may be undesirably transferred from one document to another. In addition, examples of wax containing toners include U.S. Pat. Nos. 5,482,812, 5,688,325, 5,994,020, 6,210,853 and 6,294,606, the disclosures of which are incorporated herein by reference in their entireties. For emulsion aggregation toners, for example styrene-acrylate emulsion aggregation toners, linear polyethylene waxes such as POLYWAX® 725 (available from Baker Petrolite), are useful. Conventional toners may contain and/or require a high amount of wax loading in order to achieve desirable levels of toner release. When wax is added to such toners in the bulk, and wax is substantially equally distributed throughout the toner volume, the resulting toners may contain and/or require a high amount of wax loading in order to achieve desirable levels of toner release. The high wax content of these toners can greatly increase the unit manufacturing cost of the said toners.

A number of approaches have been considered to reducing this cost including reduction of the overall bulk amount of wax added to the toner formulation. When the overall bulk wax content is lowered, the amount of wax at the toner surface is decreased, and the toner release properties, the stripper finger performance, and document offset properties of the toner composition are adversely affected. Microscopic examination of fused toners on paper has shown that there is no significant wax movement or migration from the bulk of the toner toward the surface. Therefore, it is conceivable that for fusing performance where wax is needed at the surface of the fused image, the only "useful" wax will be wax that is located near the toner surface, that is, contained in the toner shell.

Therefore, what is still needed is an improved process for forming toner particles with lower wax content, thereby improving the economic feasibility of the process, but having acceptable toner release properties, stripper finger performance and document offset properties.

SUMMARY

The toner compositions of embodiments, which may be used for low gloss, low melt applications, comprises resin, gel, pigment, wax and other components in which the wax is located predominantly in the outer volume of the toner particles. In the process of some embodiments, wax emulsion is added at an intermediate time after commencement of toner aggregation to substantially exclude said wax from the toner core. The result is a toner with fusing and charging performance equal to or better than conventional toners containing wax in the bulk, but with significantly less wax.

Embodiments are directed to toner particles, formed by emulsion aggregation processes, that include less wax than conventional toners containing wax in the bulk and maintain satisfactory toner characteristics. The present invention includes toner particles made by emulsion aggregation processes and processes for making such toner particles.

Embodiments are directed to toner particles comprising one or more resins and one or more waxes, in which the wax is substantially excluded from the toner core.

Embodiments are directed to an emulsion aggregation process for making toner particles comprising resin and wax, in which the wax is substantially outside the toner core. In particular embodiments, the process comprises providing one or more aqueous dispersions, the aqueous dispersions comprising particles including particles of one or more resins and optionally one or more colorants; mixing the aqueous dispersions, in the presence of a coagulant; adding one or more wax emulsions to the aqueous dispersions after the aqueous dispersions are mixed; aggregating particles to form aggregated particles; optionally adding one or more aqueous dispersions, which comprise particles including particles of one or more resins, to provide a shell or coating over the formed aggregate particles to form toner size particles; coalescing the toner size particles to form fused particles; and removing the fused particles from the aqueous dispersion. The addition of the wax emulsions may be performed immediately after the homogenization in some embodiments. In addition, in some embodiments, the aggregating may include heating the aqueous dispersion.

Embodiments are directed to an emulsion aggregation process for making toner particles comprising resin and wax, in which the wax is excluded from the toner core. In particular embodiments, the process comprises providing one or more aqueous dispersions, the aqueous dispersions comprising particles including particles of one or more resins and optionally one or more colorants; mixing the aqueous dispersions, in the presence of a coagulant; aggregating particles to form core particles; adding one or more aqueous dispersions, which comprise one or more wax emulsions and optionally one or more resins, to provide a shell or coating of wax and resin over the core particles; aggregating to form toner size particles; coalescing the toner size particles to form fused particles; and removing the fused particles from the aqueous dispersion.

In embodiments, the resin is chosen from thermoplastic resins, thermoset resins, curable resins and mixtures thereof. In particular embodiments, the resin is a polyester resin or a styrene copolymer.

In embodiments, the wax is chosen from natural vegetable waxes, carnauba waxes, candelilla waxes, Japan waxes, bayberry waxes, natural animal waxes, beeswax, punic waxes, lanolin, lac waxes, shellac waxes, spermaceti waxes, mineral waxes, paraffin waxes, microcrystalline waxes, montan waxes, ozokerite waxes, ceresin waxes, petrolatum waxes, petroleum waxes, synthetic waxes, Fischer-Tropsch waxes, acrylate waxes, fatty acid amide waxes, silicone waxes, polytetrafluoroethylene waxes, polyethylene waxes, polypropylene waxes, and mixtures thereof. In particular embodiments, the toner compositions have a total wax content of from about 0.01 percent by weight to about 9 percent by weight, or from about 0.1 percent by weight to about 5 percent by weight, or from about 1 percent by weight to about 3.6 percent by weight.

In particular embodiments, additives may be incorporated. These optional additives may include magnetites; curing agents; leveling agents; charge additives; flow-promoting agents; flow-control agents; plasticizers; stabilizers; anti-gassing and degassing agents, surface additives; antioxidants; UV absorbers; light stabilizers; fillers and mixtures thereof.

DETAILED DESCRIPTION OF PREFERRED EMBODIMENTS

Embodiments are generally directed to toner composition processes, and more specifically, to emulsion aggregation processes for the preparation of toner compositions. Specific embodiments are directed to the emulsion aggregation process for making toner particles, with lower total wax content, without adversely affecting the toner release properties, stripper finger performance, and document offset properties. In this process, resin is prepared as an aqueous dispersion of generally submicron sized polymeric particles (polymeric latex), which are then aggregated together with wax emulsions, optionally with dispersions of colorants and/or other additives, which also may be in the form of submicron particles, to the desired size and are then coalesced to produce toner particles.

Toner compositions according to embodiments comprise a solid film-forming resin, waxes, optionally with one or more colorants such as pigments, and optionally also containing one or more additives, such as gel latex, magnetites, curing agents, leveling agents, charge additives, flow-promoting agents, flow-control agents, plasticizers, stabilizers, anti-gassing agents, antioxidants, UV absorbing agents, light stabilizers and fillers.

The toner compositions prepared by the processes of embodiments are especially advantageous for imaging processes, especially xerographic processes, which typically demand a toner transfer efficiency in excess of about 90 percent, such as those with a compact machine design without a cleaner or those that are designed to provide high quality colored images with excellent image resolution, acceptable signal-to-noise ratio, and image uniformity. Further, toner compositions of embodiments can be selected for digital imaging systems and processes.

Embodiments also relate to toner compositions in which the toner possesses stable triboelectric charging properties, and upon fusing provides a desired gloss level, high-quality document release, offset and stripper finger performance, with a desired minimum fixing temperature (MFT), and high-quality transmission optical density.

In conventional emulsion aggregation processes for preparing toners, the wax emulsion is added to the toner formulation together with resin latex, pigment dispersion, coagulant and other components at the start of the toner aggregation process. At an intermediate stage, additional latex is added to the toner in order to form a "latex shell" around the toner in order to passivate the toner charge. Following this, the toner is frozen by raising the pH and then coalesced by heating and then cooled.

In such conventional emulsion aggregation processes, the mixture of resin latex and optional additives are mixed by any suitable method, including but not limited to agitation. The mixture is heated to a temperature at or below the glass transition temperature of the at least one resin, to aggregate the particles. However, aggregation can also be achieved without heating the composition.

To lower the wax content of the toner of certain embodiments, the wax is incorporated substantially only in the shell of the toner. This is accomplished, in embodiments, by adding wax emulsion and additional resin latex, either as a blend or separately, to the aggregated toner particle once it has been grown to an intermediate size, in order to form an outer shell that substantially comprises wax and resin. For a toner particle with a diameter of about 6 microns and having a shell thickness of about 1 micrometer, the shell volume comprises about 42 percent of the total toner volume. Thus, the opportunity to reduce overall wax content, and thereby reduce cost, is substantial.

To lower the wax content of the toner of certain other embodiments, the wax emulsion is added to the toner mixture immediately after homogenization of the resin latex and the optional components and before heating. Since the aggregated toner is already about 2 microns in diameter immediately after homogenization, the effect of this delayed addition is to exclude the wax from the toner core.

Embodiments include processes for the preparation of toner compositions comprising:

(i) blending a latex, an aqueous colorant dispersion and a gel latex, wherein the latex comprises a first non-crosslinked resin suspended in an aqueous phase in the presence of an ionic surfactant and water, the aqueous colorant dispersion comprises a colorant, water, and an ionic surfactant, and the gel latex comprises crosslinked resin particles suspended in an aqueous phase in the presence of an ionic surfactant and water;
(ii) aggregating the above blend in the presence of a coagulant, to produce a mixture;
(iii) adding a wax emulsion wherein said wax emulsion comprises a wax, water and an ionic surfactant;
(iv) heating the mixture below about, or about equal to the glass transition temperature (Tg) of the non-crosslinked resin to form toner aggregates;
(v) adding a second latex to the toner aggregates to form an aggregated suspension; wherein the second latex comprises a second non-crosslinked resin, which may be the same as or different from the first non-crosslinked resin, suspended in an aqueous phase containing ionic surfactant and water;
(vi) adding a base to increase the pH of the aggregated suspension;
(vii) heating the aggregated suspension above about, or about equal to the Tg of the non-crosslinked resins;
(viii) coalescing the aggregates by lowering the pH of the aggregated suspension with an acid;
(ix) cooling to about room temperature;
(x) optionally washing a resulting toner slurry; and
(xi) optionally isolating the toner.

Other embodiments include processes for the preparation on toner compositions comprising:

(i) blending a latex, an aqueous colorant dispersion and a gel latex, wherein the latex comprises a first non-crosslinked resin suspended in an aqueous phase in the presence of an ionic surfactant and water, the aqueous colorant dispersion comprises a colorant, water, and an ionic surfactant, and the gel latex comprises crosslinked resin particles suspended in an aqueous phase in the presence of an ionic surfactant and water;

(ii) aggregating the above blend in the presence of a coagulant, to produce a mixture;

(iii) heating the mixture below about, or about equal to the glass transition temperature (Tg) of the non-crosslinked resin to form toner aggregates;

(iv) adding a blend of a wax emulsion and a second latex to the toner aggregates to form an aggregated suspension; wherein the wax emulsion comprises wax, water and an ionic surfactant, and the second latex comprises a second non-crosslinked resin, which may be the same as or different from the first non-crosslinked resin, suspended in an aqueous phase containing ionic surfactant and water;

(v) adding a base to increase the pH of the aggregated suspension;

(vi) heating the aggregated suspension above about, or about equal to the Tg of the non-crosslinked resin;

(vii) coalescing the aggregates by lowering the pH of the aggregated suspension with an acid;

(viii) cooling to about room temperature;

(ix) optionally washing a resulting toner slurry; and (x) optionally isolating the toner.

Still other embodiments include processes for the preparation of toner compositions comprising:

(i) blending a latex, an aqueous colorant dispersion and a gel latex, wherein the latex comprises a first non-crosslinked resin suspended in an aqueous phase in the presence of an ionic surfactant and water, the aqueous colorant dispersion comprises a colorant, water, and an ionic surfactant, and the gel latex comprises crosslinked resin particles suspended in an aqueous phase in the presence of an ionic surfactant and water;

(ii) aggregating the above blend in the presence of a coagulant, to produce a mixture;

(iii) heating the mixture below about, or about equal to the glass transition temperature (Tg) of the non-crosslinked resin to form toner aggregates;

(iv) adding separately a wax emulsion and a second latex to the toner aggregates to form an aggregated suspension, wherein said wax emulsion comprises a wax, water and an ionic surfactant, and the second latex comprises a second non-crosslinked resin, which may be the same as or different from the first non-crosslinked resin, suspended in an aqueous phase containing ionic surfactant and water;

(v) adding a base to increase the pH of the aggregated suspension;

(vi) heating the aggregated suspension above about, or about equal to the Tg of the non-crosslinked resin;

(vii) coalescing the aggregates by lowering the pH of the aggregated suspension with an acid;

(viii) cooling to about room temperature;

(ix) optionally washing a resulting toner slurry; and (x) optionally isolating the toner.

In embodiments, the latex may be prepared by a batch or by a semicontinuous polymerization resulting in the submicron non-crosslinked resin particles suspended in an aqueous phase containing ionic surfactant.

In embodiments, the latex may be derived from the emulsion polymerization of monomers selected from styrene, butadiene, acrylates, isoprene, methacrylates, acrylonitrile, acrylic acid, methacrylic acid, itaconic or beta carboxyl ethyl acrylate (β-CEA) and the like. The latex may also contain an anionic surfactant, such as sodium dodecylbenzene sulfonate (SDS). Known chain transfer agents, such as dodecanethiol carbon tetrabromide in effective amounts, for example, from about 0.1 to about 10 percent, may also be included in embodiments, to control the molecular weight properties of the resin if prepared by emulsion polymerization.

The latex of embodiments may comprise submicron non-crosslinked resin particles of about 50 to about 500 nanometers, or of about 70 to about 350 nanometers, suspended in an aqueous water phase containing an ionic surfactant, wherein the ionic surfactant is selected in an amount from about 0.5 to about 5 percent by weight, or from about 0.7 to about 2 percent by weight of the solids.

The non-crosslinked resin may be present in the toner composition of embodiments from about 75 weight percent to about 98 weight percent, or from about 80 to about 95 weight percent of the toner or of the solids. The non-crosslinked resin preferably has a size of about 50 to about 500 nanometers in volume average diameter as measured, for example, by a Brookhaven nanosize particle analyzer.

Suitable non-crosslinked resins that may be included in the latexes of embodiments include but are not limited to one or more of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid); poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly (styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly(styrene-butadiene), poly(styrene-isoprene), poly (styrene-butyl methacrylate), poly(styrene-butyl acrylate-acrylic acid), poly(styrene-butyl methacrylate-acrylic acid), poly(butyl methacrylate-butyl acrylate), poly(butyl methacrylate-acrylic acid), poly(acrylonitrile-butyl acrylate-acrylic acid), and mixtures thereof. In particular embodiments, the non-crosslinked resin is poly(styrene/butyl acrylate/beta carboxylethyl acrylate).

Other processes for obtaining resin particles of, for example, about 0.01 to about 7 microns can be produced by a polymer microsuspension process, such as disclosed in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding processes, or other known processes. Also, reactant initiators, chain transfer agents, and the like can be used for the processes. Examples of water soluble initiators include, ammonium sodium, and potassium persulfates in suitable amounts, of about 0.1 to about 8 percent by weight of monomer, and more preferably of from about 0.2 to about 5 percent by weight of monomer. Examples of chain transfer agents include dodecanethiol, dodecylmercaptan, octanethiol, carbon tetrabromide, carbon tetrachloride, and the like in various suitable amounts, and are of about 0.1 to about 10 percent by weight of monomer, and preferably of about 0.2 to about 5 percent by weight of monomer.

The toner compositions of embodiments include suitable waxes. In embodiments, wax may be present in a toner composition in an amount of about 0.01 percent by weight to about 9 percent by weight, based on the weight of the toner composition. In embodiments, the wax is present in the toner composition in an amount of about 0.1 percent by weight to about 5 percent by weight, or about 1 percent by weight to about 3.6 percent by weight, based on the weight of the toner composition.

To incorporate wax into a toner composition, it is necessary for the wax to be in the form of an aqueous emulsion or dispersion of solid wax particles in water. Emulsions, by the classical definition, are mixtures of two immiscible liquids stabilized by an emulsifier, and therefore, in the case of wax, exist only when the wax is in its molten state as the emulsion is formed. However, the terminology "wax emulsion" is widely used in the industry and herein to describe both true wax emulsions and dispersions of solid wax in solvents, such as water.

The wax emulsions of embodiments comprise submicron wax particles of from about 50 to about 500 nanometers, or of from about 100 to about 350 nanometers, suspended in an aqueous water phase containing an ionic surfactant. The ionic surfactant may be present in an amount of from about 0.5 percent by weight to about 10 percent by weight, and of from about 1 percent by weight to about 5 percent by weight of the wax.

The wax emulsions according to embodiments comprise one or more wax selected from a natural vegetable waxes, natural animal waxes, mineral waxes, synthetic waxes and functionalized waxes. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes include, for example, Fischer-Tropsch wax, acrylate wax, fatty acid amide wax, silicone wax, polytetrafluoro-ethylene wax, polyethylene wax, and polypropylene wax, and mixtures thereof.

Examples of waxes of embodiments include polypropylenes and polyethylenes commercially available from Allied Chemical and Baker Petrolite, wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasei K.K., and similar materials. The commercially available polyethylenes usually possess a molecular weight Mw of from about 1,000 to about 1,500, while the commercially available polypropylenes utilized have a molecular weight of about 4,000 to about 5,000. Examples of functionalized waxes include amines, amides, imides, esters, quaternary amines, carboxylic acids or acrylic polymer emulsion, for example, JONCRYL 74, 89, 130, 537, and 538, all available from Johnson Diversey, Inc., chlorinated polypropylenes and polyethylenes commercially available from Allied Chemical and Petrolite Corporation and JohnsonDiversey, Inc. Many of the polyethylene and polypropylene compositions useful in embodiments are illustrated in British Pat. No. 1,442,835, the entire disclosure of which is incorporated herein by reference.

In embodiments in which the wax is a polyethylene wax, the wax may have a weight average molecular weight (Mw) of about 500 to about 2,500, or of about 600 to about 1,500, a number average molecular weight (Mn) of about 400 to about 2,000, or of about 700 to about 1,500, a melting temperature of about 70 to about 130° C., or of about 80 to about 110° C., and a particle size of about 50 to about 500 nanometers, or from about 100 to about 300 nanometers.

In embodiments in which the wax is a mixture of two or more waxes, the ratio of the waxes may be in the range of about 1:99 to about 99:1, in the range of about 10:90 to about 90:10, or in the range of about 25:75 to about 75:25, where the ratio is a weight ratio or a volume ratio. When two or more waxes are present, the two or more waxes may embody wax emulsions uniformly dispersed together to produce a single wax emulsion.

In embodiments, additional additives may be incorporated, optionally in the form of dispersions, to the latex emulsion of resin prior to aggregation. Additives may be added, in embodiments, for any of various reasons, including, but not limited to, providing color, improving charging characteristics and improving flow properties. For example, additives including, but not limited to, colorants; magnetites; flocculates; curing agents; leveling agents, such as silicone; charge additives; flow-promoting agents, such as silicas; flow-control agents; plasticizers; stabilizers, such as stabilizers against UV degradation; anti-gassing and degassing agents, such as benzoin, surface additives; antioxidants; UV absorbers; light stabilizers and fillers, such as calcium sulfate or barium sulfate, may be included. In embodiments, where high gloss is desired, toner compositions can be formulated free of pigment.

In various embodiments, a colorant may be included in known amounts, to achieve a desired color strength. For example, in embodiments, at least one dye, pigment and/or other colorant is included in a toner composition in a suitable amount. In embodiments, the at least one dye, pigment and/or other colorant is included in an amount from about 1 to about 20 percent by weight of the toner composition. In various exemplary embodiments, the colorant is included in an amount of from about 2 to about 10 percent by weight of the toner composition.

Colorants that may be incorporated into embodiments include pigments, dyes, mixtures of pigments, mixtures of dyes and mixtures of pigments with dyes, and the like. For example, various known black, cyan, magenta, yellow, red, green, brown, or blue colorants, or mixtures thereof may be incorporated into toner compositions of embodiments. The colorant may be, for example, dyes, pigments, mixtures thereof, mixtures of pigments, mixtures of dyes, and the like. The colorant may have, in embodiments, a mean colorant size of from about 50 to about 150 nanometers. The pigment or pigments can be used as water-based pigment dispersions in embodiments.

Illustrative examples of colorants, such as pigments, that may be used in the processes of embodiments include, but are not limited to, carbon black, such as REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. Colored pigments or dyes, including cyan, magenta, yellow, red, green, brown, blue and/or mixtures thereof, may also be used.

Specific examples of pigments added in embodiments, include, but are not limited to, SUNSPERSE 6000™, FLEXIVERSE™ and AQUATONE™ water-based pigment dispersions from SUN Chemicals, phthalocyanine HELIOGEN BLUE L6900™, D6840™, D7080™, D7020™, PYLAM OIL BLUE™, PYLAM OIL YELLOW™, PIGMENT BLUE 1™, available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, CINQUASIA MAGENTATA™ available from E.I. DuPont de Nemours & Company, Pigment Yellow 180, Pigment Yellow 12, Pigment Yellow 13, Pigment Yellow 14, Pigment Yellow 17, Pigment Blue 15, Pigment Blue 15:3, Pigment Red 122, Pigment Red 57:1, Pigment Red 81:1, Pigment Red 81:2, Pigment Red 81:3, and the like. Examples of magentas include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments in the processes. Dyes can be used instead of or as well as pigments.

The gel latex of embodiments may comprise a crosslinked resin and/or a crosslinked resin of a non-crosslinked resin with crosslinking.

The crosslinked resin of embodiments ma comprises one or more crosslinked polymer such as crosslinked poly(styrene-alkyl acrylate), poly(styrene-butadiene), poly(styrene-isoprene), poly(styrene-alkyl methacrylate), poly(styrene-alkyl acrylate-acrylic acid), poly(styrene-butadiene-acrylic acid), poly(styrene-isoprene-acrylic acid), poly(styrenealkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrileacrylic acid), and crosslinked poly(alkyl acrylate-acrylonitrile-acrylic acid), and/or mixtures thereof.

A crosslinking agent, such as divinyl benzene, may be used in embodiments in an effective amount, such as about 0.01 percent by weight to about 25 percent by weight, or about 0.5 to about 10 percent by weight. Further examples of linear polymers that may be used in embodiments include those similar to, or the same as, the crosslinked polymers with the exception that the linear polymers are free of crosslinking. The crosslinked polymer of embodiments may contain divinyl benzene as an additional monomer during the latex formation.

In embodiments, the crosslinked resin particles may be present in an amount of about 0.1 to about 50 weight percent, or of about 1 to about 20 percent by weight of the toner.

In embodiments, the gel latex may comprise submicron crosslinked resin particles of about 10 to about 200 nanometers, or of about 20 to about 100 nanometers, suspended in an aqueous phase containing an ionic surfactant. The ionic surfactant may be included in such embodiments in an amount from about 0.5 to about 5 percent by weight, or of about 0.7 to about 2 percent by weight of the solids.

In embodiments, a matte developed finish may be observed when the crosslinked resin amount is from about 0.1 to about 70 percent by weight of the toner, or from about 1 to about 50 percent by weight of the toner, or even from about 5 to about 20 percent by weight of the toner. The toner of embodiments may exhibit a low matte finish where the gloss of the toner is less than about 30 GGU, or less than about 20 GGU.

Surfactants for the preparation of latexes and wax and colorant dispersions can be ionic or nonionic surfactants in an amount of about 0.01 percent by weight to about 15 percent by weight, or about 0.01 percent by weight to about 5 percent by weight, of the reaction mixture. Examples of anionic surfactants are sodium dodecylsulfate (SDS), sodium dodecylbenzene sulfonate, sodium dodecylnaphthalene sulfate, dialkyl benzenealkyl sulfates and sulfonates, abitic acid, NEOGEN R™, NEOGEN SC™ obtained from Kao, and the like. Examples of nonionic surfactants for the colorant dispersion in an amount of about 0.1 percent by weight to about 5 percent by weight, are polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™.

In embodiments, the pH of the blend may be from about 2 to about 2.6, at the start of aggregating.

In embodiments, aggregating comprises stirring and heating the mixture at about a temperature below about, or about equal to, the Tg of the non-crosslinked resin.

In embodiments, aggregating occurs at a temperature of about 40° C. to about 62° C., more preferably from about 45° C. to about 58° C.

In embodiments, one or more coagulant, which may be in a nitric acid solution, is added during or prior to aggregating the latex, the aqueous colorant dispersion, the wax dispersion and the gel latex over a period of about 1 to about 5 minutes, or over a period of about 1 to about 3 minutes, and the coagulant enables or initiates the aggregation and coalescence.

Examples of coagulants that may be used in embodiments include but are not limited to polyaluminum halides such as polyaluminum chloride (PAC), or the corresponding bromide, fluoride, or iodide, polyaluminum silicates, such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate and the like, and mixtures thereof. The polymetal salt can be in a solution of nitric acid.

The coagulant may be added in embodiments is in about 0.02 to about 0.3 percent by weight, and preferably from about 0.05 to about 0.2 percent by weight of the toner. The coagulant may be present in embodiments in an amount of about 0.05 pph to about 0.5 pph.

In embodiments, the coagulant is PAC, which is commercially available, and can be prepared by the controlled hydrolysis of aluminum chloride with sodium hydroxide. Generally, the PAC can be prepared by the addition of two moles of a base to one mole of aluminum chloride. The species is soluble and stable when dissolved and stored under acidic conditions if the pH is less than 5. The species in solution is believed to be of the formula $Al_{13}O_4(OH)_{24}(H_2O)_{12}$ with 7 positive electrical charges per unit.

In embodiments, a second latex may be added to the toner aggregates in an amount of about 10 to about 40 percent by weight of the initial latex, or in an amount of about 15 to about 30 percent by weight, to form a shell or coating on the toner aggregates wherein the thickness of the shell is about 200 to about 800 nanometers.

In embodiments, the latex resin and the second latex resin may comprise the same non-crosslinked resin or different non-crosslinked resins.

The latex and second latex of embodiments may be prepared with initiators, wherein the second latex added to the already preformed aggregates in the size range of about 4 to about 6.5 μm, include water soluble initiators, such as ammonium and potassium persulfates in suitable amounts, such as about 0.1 to about 8 weight percent, or about 0.2 to about 5 weight percent. Examples of organic soluble initiators include Vazo peroxides, such as Vazo 64, 2-methyl 2-2'-azobis propanenitrile, and Vazo 88, 2-2'-azobis isobutyramide dehydrate in a suitable amount, such as from about 0.1 to about 8 percent. Examples of chain transfer agents include dodecane thiol, octane thiol, carbon tetrabromide and the like in various suitable amounts, such as about 0.1 to about 10 percent, or about 0.2 to about 5 percent by weight of the monomer. Examples of chain transfer agents include dodecanethiol, octanethiol, carbon tetrabromide and the like in various suitable amounts of about 0.1 to about 10 percent, or of about 0.2 to about 5 percent by weight of the monomer.

The base of embodiments comprises any suitable base such as, for example, an alkali metal hydroxides such as, for example, sodium hydroxide, potassium hydroxide, and ammonium hydroxide. The alkali metal hydroxide added may be about 6 to about 25 percent, or from about 10 to about 20 percent, by weight. The base may increase the pH to about 5 to about 9, or to about 6 to about 8.

The acid added to embodiments may comprise any suitable acid such as, for example, nitric acid, sulfuric acid, hydrochloric acid, citric acid or acetic acid. The amount of acid added may be from about 4 to about 30 percent by weight, or from about 5 to about 15 percent, by weight. The acid may decrease the pH to about 2.8 to about 6, or to about 3.5 to about 5.

In embodiments, a charge additive may be used in suitable effective amounts. In embodiments, the charge additive is used in amounts from about 0.1 percent by weight to about 15 percent by weight of the toner composition. In embodiments, the charge additive is used in amounts from about 1 percent by weight to about 15 percent by weight of the toner composition. In embodiments, the charge additive is used in amounts from about 1 percent by weight to about 3 percent by weight of the toner composition. Suitable charge additives in embodiments include, but are not limited to, alkyl pyridinium halides, bisulfates, the charge control additives of U.S. Pat. Nos. 3,944,493; 4,007,293; 4,079,014; 4,394,430 and 4,560,635, the disclosures of which are hereby incorporated by reference in their entirety, negative charge enhancing additives, such as, for example, aluminum complexes, and other charge additives known in the art or later discovered or developed.

The toner compositions of embodiments may also include fillers, such as, for example, quartz; silicates; aluminosilicates; corundum; ceramic fillers; glass; carbonates, such as chalk, kaolin; inorganic fibers and the like; calcium sulfate; barium sulfate; magnesium sulfate; and any other known or later developed filler materials, and are included in amounts suitable to adjust the Theological characteristics of the toner composition.

Furthermore, the toner compositions of embodiments can also include release or leveling agents such as silicones for their known effect. Suitable silicone leveling agents include, but are not limited to, resin such as dialkyl polysiloxane with terminal functionality selected from the group consisting of amino, hydroxyl, carboxyl, carbinol, (meth)acrylate, halo alkoxy, hydride, haloalkyl, mercapto, acid anhydride, carboxyalkyl, and vinyl groups; and crosslinked polydimethylsiloxane. The commercially available silicones selected possess, for example, a weight average molecular weight of from about 1,000 to about 200,000, while the commercially available crosslinked siloxanes utilized are believed to have a weight average molecular weight of from about 40,000 to about 1,000,000.

The aggregation step conditions may be continued for a period of time until toner composition particles of the desired size and size distribution are obtained. The size may be monitored by taking samples from the vessel and evaluating the size of the toner composition particles, for example with a particle sizing apparatus. In various exemplary embodiments, the aggregate particles have volume average diameter of less than 30 microns, from about 1 to about 25 microns, or from about 3 to about 10 microns, and narrow GSD of, for example, from about 1.10 to about 1.3, or from about 1.15 to about 1.25, as measured by a particle sizing apparatus, such as a particle sizing apparatus which makes use of the Coulter principle, such as a COULTER COUNTER, can be obtained.

Once the aggregate particles reach the desired size, the resulting suspension is allowed to coalesce.

The particles obtained after the aggregation step can be subjected to washing/rinsing with, for example, water to remove residual aggregating agent, and drying, to obtain toner composition particles comprised of resin, wax and optional additives, such as colorants and curing agents. In addition, the toner composition particles may be subjected to screening and/or filtration steps to remove undesired coarse particles from the toner composition.

In embodiments, coalescing the toner comprises stirring and heating at a temperature of above about, or about equal to, the Tg of the non-crosslinked resin for a period from about 0.5 to about 1.5 hours.

In embodiments, a temperature of the coalescing is from about 75° C. to about 97° C., and more preferably from about 85° C. to about 95° C.

Coalescing may be accelerated by additional stirring.

Coalescing, in embodiments, comprises stirring and heating at a temperature of about 75° C. to about 97° C., in embodiments, at a temperature of about 85° C. to about 95° C., for a period of about 0.5 to about 6 hours, and, in particular embodiments, from about 2 to about 5 hours.

The cooling of the aggregated mixture in embodiments may be slowly cooled to an ambient temperature of about 20° C. to about 40° C. over a period of about 1 to about 8 hours, and, in certain embodiments, from about 1 to about 5 hours.

The washing may be carried out at a pH of from about 7 to about 12, and, in embodiments, at a pH of from about 9 to about 11, at a temperature of from about 45 to about 70° C., or from about 50 to about 70° C. The washing may comprise filtering and reslurrying a filter cake comprised of toner particles in deionized water. The filtering and reslurrying may be washed one or more times by deionized water, or washed by a single deionized water wash at a pH of about 4 wherein the pH of the slurry is adjusted with an acid, and followed optionally by one or more deionized water washes.

The toner of embodiments comprises particles having a volume average diameter of less than about 30 microns, such as from about 1 to about 15 microns, or from about 3 to about 10 microns, and a particle size distribution of less than about 1.3, such as from about 1.0 to about 1.3, or from about 1.15 to about 1.25; each measured, for example, with a article sizing apparatus, such as a particle sizing apparatus which makes use of the Coulter principle, such as a COULTER COUNTER, wherein the toner has stable triboelectric charging performance. A narrow particle size distribution enables a clean transfer of toner particles, thereby providing enhanced resolution of the resulting developed fused images. The toner particles of embodiments may comprise a small particle size and narrow size distribution.

The toner of embodiments may have a low fusing temperature and wide fusing latitude, wherein a minimum fix temperature is about 120° C. to about 200° C., or about 150° C. to about 180° C., and the fusing latitude is greater than about 10° C., or about 10° C. to about 100° C., and or even about 20° C. to about 100° C.

The toner produced by embodiments may have excellent blocking properties at and above about 45° C. In embodiments, the toner composition may have a low image gloss, wherein the 75 degree gloss is less than 30 GGU, or about 10 to about 20 GGU as measured, for example, with a BYK Gardner micro-gloss meter.

The toner of embodiments may have a high transmission optical density, wherein the transmission optical density is greater than about 1.4, and preferably is about 1.4 to about 2.0 as measured, for example, with a Macbeth TR924 densitometer.

The toner of embodiments may exhibit excellent stripper finger performance wherein substantially no stripper fingers marks, for example, scratch marks and changes in image gloss, are detected on fused images of said toner.

The toner of embodiments may exhibit excellent document offset performance wherein substantially no toner offset is observed from a fused image document to an adjoining fused image document, toner-to-toner and toner-to-paper transfer, wherein the documents are stored under a load of 80 grams per centimeter at 60° C. and 50 percent relative humidity for about 24 hours.

Surface additives may be added to the toner composition particles after isolation by, for example, filtration, and then optionally followed by washing and drying. Suitable external surface additives include, for example, metal salts, metal salts of fatty acids, colloidal silicas, titanium oxides, mixtures thereof, and the like, which additives may be present in an amount of from about 0.1 percent by weight to about 2 percent by weight, as disclosed in U.S. Pat. Nos. 3,590,000; 3,720,617; 3,655,374 and 3,983,045, the disclosures of which are incorporated herein by reference in their entirety. These additives can be selected in amounts of, for example, from about 0.1 percent by weight to about 2 percent, and can be incorporated during the aggregation, or blended into the formed toner composition. The toner composition may also include known charge additives in effective amounts of, for example, from about 0.1 percent by weight to about 5 percent by weight, such as alkyl pyridinium halides, bisulfates, the charge control additives of U.S. Pat. Nos. 3,944,493; 4,007,293; 4,079,014; 4,394,430 and 4,560,635, the disclosures which are incorporated herein by reference in their entirety, negative charge enhancing additives like aluminum complexes, and the like. Other known positive and negative enhancing charge additives may also be selected.

In embodiments, the toner composition may incorporate, for example by dry-blending, one or more additive, such as fluidity-assisting additives, for example, those disclosed in WO 94/11446, curing agents; flow-promoting and flow-control agents; charge additives, such as those described above; and fillers such as aluminum oxide and silica, either singly or in combination. In addition, other additives may be included.

The toner compositions may also optionally be blended with flow-promoting and flow-control agents, such as external additive particles, which are usually present on the surface of the toner compositions. Examples of these additives include, but are not limited to, metal oxides such as titanium oxide, tin oxide, mixtures thereof, and the like; colloidal silicas such as AEROSIL; metal salts and metal salts of fatty acids including zinc stearate, aluminum oxides, cerium oxides; and mixtures thereof. These flow-aid agents are generally present in amounts of from about 0.1 percent by weight to about 5 percent by weight, and in amounts of from about 0.1 percent by weight to about 1 percent by weight. Several of the aforementioned additives are illustrated in U.S. Pat. Nos. 3,590,000 and 3,800,588, the disclosures of which are incorporated herein by reference in their entirety.

The total content of dry-blended additives incorporated with the toner composition of embodiments may be in the range of from about 0.01 percent by weight to about 10 percent by weight, and in some embodiments, may be in the range of from about 0.1 percent by weight to about 1.0 percent by weight, based on the total weight of the composition without the additives. However, higher or lower amounts of additives may also be used.

The process of embodiments can be used to produce toner particles within any sized reactor, and is thus commercially significant. Scaling up of the process from bench reactors to larger reactors can be readily achieved by practitioners in the art.

The resulting toners can be selected for known electrophotographic imaging, digital, printing processes, including color processes, and lithography. The toners obtained are especially useful for the development of colored images with excellent line and solid resolution, and wherein substantially no background deposits are present.

Developer compositions can be prepared by mixing the toners obtained with the process of embodiments with known carrier particles, including coated carriers, such as steel, ferrites, and the like, such as those disclosed in U.S. Pat. Nos. 4,937,166 and 4,935,326, the disclosures of which are incorporated herein by reference in their entirety, for example from about 2 percent by weight to about 15 percent toner. The carrier particles may also be comprised of a carrier core with a polymer coating, or coatings thereover, and dispersed therein a conductive component like a conductive carbon black in an amount, for example, of from about 5 percent to about 60 by weight.

Toners and developers of embodiments may thus be used in imaging processes.

EXAMPLES

The following Examples are provided to further illustrate embodiments.

Comparative Example 1

Toner Composition Comprising 9 Percent by Weight of Wax in Bulk 191.40 g of styrene/butylacrylate/β-CEA resin latex with resin onset Tg of about 51° C., 75.00 g of styrene/butylacrylate/divinylbenzene/β-CEA gel latex, 54.3 g of aqueous POLYWAX® 850 wax emulsion and 9.9 grams of aqueous charge control solution containing calcium chloride were added to 479.1 g of deionized water in a vessel and stirred using an IKA ULTRA TURRAX® T50 homogenizer operating at about 4,000 revolutions per minute (rpm). Thereafter, 114.0 g of black pigment dispersion containing REGAL® 330 carbon black and NEOGEN RK™ anionic surfactant was added, followed by drop-wise addition of 30.6 g of a coagulant mixture containing polyaluminum chloride mixture and 0.02 molar nitric acid solution. As the coagulant mixture was added drop-wise, the homogenizer speed was increased to about 5,200 rpm and homogenized for an additional 5 minutes.

The mixture was transferred to a 2-liter glass reactor and heated at about 1° C. per minute to a temperature of about 52° C. and held there for a period of about 1.5 to about 2 hours resulting in a volume average particle diameter of about 5 microns as measured with a particle size measuring device that uses the Coulter principle, such as COULTER COUNTER. During heating, the stirrer was run at about 250 rpm and 10 minutes after the set temperature of about 52° C. was reached, the stirrer speed was reduced to about 220 rpm.

124.6 g of additional styrene/butylacrylate/β-CEA resin latex was added to the reactor mixture and allowed to aggregate for an additional period of about 30 minutes at about 52° C., resulting in a volume average particle diameter of about 5.5 microns. The particle size was frozen by adjusting the reactor mixture pH to 7 by adding 1.0 molar (M) sodium hydroxide solution. The reactor mixture was heated at about 1° C. per minute to a temperature of about 93° C., followed by adjusting the reactor mixture pH to 4.5, and then 30 minutes later to 4.0 adding 0.3 M nitric acid solution. Following this, stirring of the reactor mixture was continued at about 93° C. for 4 hours to enable the particles to coalesce and spherodize. The reactor heater was then turned off and the reactor mixture is allowed to cool to room temperature overnight, for about 10 to about 12 hours.

The resulting toner mixture was comprised of about 16.7% of toner, 0.4% of anionic surfactant and about 82.7% by weight of water. The toner of this mixture comprised about 81% styrene/butyl acrylate/beta carboxy ethyl acrylate copolymer, about 10% of pigment and about 9 percent by weight of wax. The volume average particle diameter and volume volume particle size distribution of the toner were 5.8 microns and 1.21, respectively. The resulting toner was washed and dried Fusing data is shown in Table 1.

Comparative Example II

Toner Composition Comprising 7 Percent by Weight of Wax in Bulk 200.3 g of styrene/butylacrylate/β-CEA resin latex with resin onset Tg of about 51° C., 75.0 g of styrene/butylacrylate/divinylbenzene/β-CEA gel latex, 42.2 g of aqueous POLYWAX® 850 wax emulsion and 9.9 g of aqueous charge control solution containing calcium chloride were added to 482.2 g of deionized water in a vessel and stirred using an IKA ULTRA TURRAX® T50 homogenizer operating at about 4,000 rpm. Thereafter, 114.0 g of black pigment dispersion containing REGAL® 330 carbon black and NEOGEN RK™ anionic surfactant was added, followed by drop-wise addition of 30.6 g of a coagulant mixture containing polyaluminum chloride mixture and 0.02 molar nitric acid solution. As the coagulant mixture was added drop-wise, the homogenizer speed was increased to about 5,200 rpm and homogenized for an additional 5 minutes.

The mixture was transferred to a 2-liter glass reactor and heated at about 1° C. per minute to a temperature of about 52° C. and held there for a period of about 1.5 to about 2 hours resulting in a volume average particle diameter of about 5 microns as measured with a COULTER COUNTER. During heating, the stirrer was run at about 250 revolutions per minute. About 10 minutes after the set temperature of about 52° C. was reached, the stirrer speed was reduced to about 220 rpm.

124.6 g of additional styrene/butylacrylate/β-CEA resin latex was added to the reactor mixture and allowed to aggregate for an additional period of about 30 minutes at about 52° C., resulting in a volume average particle diameter of about 5.5 microns. The particle size was frozen by adjusting the reactor mixture pH to 7 by adding 1.0 molar sodium hydroxide solution. The reactor mixture was heated at about 1° C. per minute to a temperature of about 93° C., followed by adjusting the reactor mixture pH to 4.5, and then 30 minutes later to 4.0 adding 0.3 molar nitric acid solution. Following this, the reactor mixture was continued to be stirred at about 93° C. for 4 hours to enable the particles to coalesce and spherodize. The reactor heater was then turned off and the reactor mixture was allowed to cool to room temperature overnight, for about 10 to about 12 hours.

The resulting toner mixture was comprised of about 16.7% of toner, 0.4% of anionic surfactant and about 82.7% by weight of water. The toner of this mixture comprised about 83% styrene/butyl acrylate/beta carboxy ethyl acrylate copolymer, about 10% of pigment and about 7% by weight of wax. The volume average particle diameter and volume particle size distribution of the toner was 5.8 microns and 1.20, respectively. The resulting toner was washed and dried. Fusing data is shown in Table 1.

Example 1

Toner Composition Comprising 3.6 Percent by Weight of Wax 215.7 g of styrene/butylacrylate/β-CEA resin latex with a resin onset Tg of about 51° C. and 75.0 g of styrene/butylacrylate/divinylbenzene/β-CEA gel latex were added to 471.4 g of deionized water in a vessel and stirred using an IKA ULTRA TURRAX® T50 homogenizer operating at about 4,000 rpm. 114.0 g of a black pigment dispersion containing REGAL® 330 carbon black and NEOGEN RK™ anionic surfactant was added, followed by drop-wise addition of 30.6 g of a coagulant mixture containing polyaluminum chloride mixture and 0.02 M nitric acid solution. As the coagulant mixture is added drop-wise, the homogenizer speed was increased to about 5,200 rpm and homogenized for an additional 5 minutes.

The mixture was transferred to a 2-liter glass reactor and heated at about 1° C. per minute to a temperature of about 52° C. and held there for a period of about 1.5 to about 2 hours resulting in a volume average particle diameter of about 5 microns as measured with a COULTER COUNTER. During heating, the stirrer was run at about 250 rpm and 10 minutes after the set temperature of about 52° C. was reached, the stirrer speed was reduced to about 220 rpm.

124.6 g of additional styrene/butylacrylate/β-CEA resin latex and 21.4 g of POLYWAX® 850 wax emulsion were mixed together in a beaker, homogenized with a IKA ULTRA TURRAX® T8 homogenizer operating at about 25,000 rpm for about 3 minutes, and then added to the reactor mixture and allowed to aggregate for an additional period of about 30 minutes at 52° C., resulting in a volume average particle diameter of about 5.5 microns. The particle size was frozen by adjusting the reactor mixture pH to 7 by adding 1.0 M sodium hydroxide solution.

The reactor mixture was heated at about 1° C. per minute to a temperature of about 93° C., followed by adjusting the reactor mixture pH to 4.5, and then 30 minutes later to 4.0 adding 0.3 M nitric acid solution. Stirring was continued at about 93° C. for 4 hours to enable the particles to coalesce and spherodize. The reactor heater was then turned off and the reactor mixture was allowed to cool to room temperature overnight, for about 10 to about 12 hours.

The resulting toner mixture was comprised of about 16.7% of toner, 0.4% of anionic surfactant and about 82.7% by weight of water. The toner of this mixture comprised about 86.4% styrene/butyl acrylate/beta carboxy ethyl acrylate copolymer, about 10% of pigment and about 3.6 percent by weight of wax. The volume average particle diameter and volume particle size distribution of the toner were 6.1 microns and 1.23, respectively. Fusing data is shown in Table 1.

Example 2

Toner Composition Comprising 5 Percent by Weight of Wax 209.2 g of styrene/butylacrylate/β-CEA resin latex with resin onset Tg of about 51° C. and 75.0 g of styrene/butylacrylate/divinylbenzene/β-CEA gel latex were added to 449.6 g of deionized water in a vessel and stirred using an IKA ULTRA TURRAX® T50 homogenizer operating at about 4,000 revolutions per minute. Thereafter, 114.0 g of a black pigment dispersion containing REGAL® 330 carbon black and NEOGEN RK™ anionic surfactant was added, followed by addition of 9.9 g of an aqueous charge control solution containing calcium followed by drop-wise addition of 30.6 g of a coagulant mixture containing polyaluminum chloride mixture and 0.02 M nitric acid solution. As the flocculent mixture was added drop-wise, the homogenizer speed was increased to about 5,200 revolutions per minute. 30.2 g of an aqueous POLYWAX® 850 wax emulsion was added to the above mixture and said mixture was homogenized for an additional 5 minutes.

The mixture was then transferred to a 2-liter glass reactor and heated at about 1° C. per minute to a temperature of about 51° C. and held there for a period of about 1.5 to about 2 hours resulting in a volume average particle diameter of about 5.0 microns as measured with a COULTER COUNTER. During heating, the stirrer was run at about 360 rpm and 10 minutes after the set temperature of about 51° C. was reached, the stirrer speed was reduced to about 220 rpm.

124.60 g of additional styrene/butylacrylate/β-CEA was added to the reactor mixture and allowed to aggregate for an additional period of about 30 minutes at about 51° C. resulting in a volume average particle diameter of about 5.5 microns. The particle size was frozen by adjusting the reactor mixture pH to about 7.0 by adding 1.0 M sodium hydroxide solution.

The reactor mixture was heated at about 1° C. per minute to a temperature of about 93° C., followed by adjusting the reactor mixture pH to about 4.2, and then 30 minutes later to about 3.7 by adding 0.3 M nitric acid solution. Stirring was continued at 93° C. for about 4 hours to enable the particles to coalesce and spherodize. The reactor heater was then turned off and the reactor mixture was allowed to cool to room temperature overnight, for about 10 to about 12 hours.

The resulting toner mixture was comprised of about 17.2% of toner, 0.4% of anionic surfactant and about 82.1% by weight of water. The toner of this mixture comprised about 85% styrene/butyl acrylate/beta carboxy ethyl acrylate copolymer, about 10% of pigment and about 5 percent by weight of wax. The volume average particle diameter and volume particle size distribution of the toner was 5.65 microns and 1.21, respectively. The resulting toner was washed and dried. Fusing data is shown in Table 1. The minimum fix temperature and hot offset temperature are not affected by the delayed wax addition as compared with the control toner of Comparative Example 1. No finger marks were detected.

Fusing performance of the toners of Comparative Examples 1 and 2, and Examples 1 and 2 are shown in Table 1.

TABLE 1

| | Wax Content (%) | Minimum Fix Temperature (° C.) | Hot Offset Temperature (° C.) | Stripper Finger Marks |
|---|---|---|---|---|
| Comparative Example 1 | 9 | 170 | ≧210 | None |
| Comparative Example 2 | 7 | 175 | ≧210 | Poor |
| Example 1 | 3.6 | 178 | ≧210 | None |
| Example 2 | 5 | 172 | ≧210 | None |

From Table 1, it can be seen that the lowering of bulk wax from 9% to 7% by weight has no significant effect on fusing performance of the toners, particularly minimum fix temperature and hot offset temperature. However, the decrease in bulk wax content from Comparative Example 1 to Comparative Example 2 demonstrates a significant adverse effect on stipper finger mark performance. In contrast, lowering the wax content can be achieved by delayed wax process as shown in Example 1 and Example 2, wherein the wax is substantially excluded from the toner core, with significant effect on fusing performance observed. Not only the minimum fusing temperature and hot offset temperature were not affected by the delayed wax addition, but also, the stripper finger performance of these toners were excellent.

While the above has been described in conjunction with the exemplary embodiments outlined above, various alternatives, modifications, variations, improvements, and/or substantial equivalents, whether known or that are, or may be, presently unforeseen, may become apparent to those having at least ordinary skill in the art. Accordingly, the exemplary embodiments, as set forth above, are intended to be illustrative, not limiting. Various changes may be made without departing from the spirit and scope. Therefore, this application is intended to embrace all known or later-developed alternatives, modifications, variations, improvements, and/or substantial equivalents.

What is claimed is:

1. A toner composition comprising toner particles formed by an emulsion aggregation process, wherein the emulsion aggregation process comprises:

(i) providing one or more aqueous dispersions, the aqueous dispersions comprising particles including particles of one or more resins;

(ii) mixing the aqueous dispersions in presence of a coagulant;

(iii) adding one or more wax emulsions to the aqueous dispersions;

(iv) aggregating to form aggregated particles;

(v) adding one or more aqueous dispersions, which comprise particles including particles of one or more resins, to form toner size particles;

(vi) coalescing the toner size particles to form fused particles; and (vii) removing the fused particles from the aqueous dispersion;

wherein said adding one or more wax emulsions is performed after said mixing;

the fused particles have an average particle diameter of from about 1 to about 15 microns, with a particle geometric size distribution of less than about 1.3; and wherein the waxes are excluded from an interior core of the toner particles.

2. The toner composition according to claim 1, wherein the resins are chosen from the group consisting of styrene, butadiene, acrylates, isoprene, methacrylates, acrylonitrile, acrylic acid, methacrylic acid, beta carboxylethyl acrylate (β-CEA), polyesters, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid); poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly(styrene-butadiene), poly(styrene-isoprene), poly(styrene-butyl methacrylate), poly(styrene-butyl acrylate-acrylic acid), poly(styrene-butyl methacrylate-acrylic acid), poly(butyl methacrylate-butyl acrylate), poly(butyl methacrylate-acrylic acid), poly(acrylonitrile-butyl acrylate-acrylic acid), and mixtures thereof.

3. The toner composition according to claim 1, wherein the waxes are one or more wax chosen from the group consisting of natural vegetable waxes, carnauba waxes, candelilla waxes, Japan waxes, bayberry waxes, natural animal waxes, beeswax, punic waxes, lanolin, lac waxes, shellac waxes, spermaceti waxes, mineral waxes, paraffin waxes, microcrystalline waxes, montan waxes, ozokerite waxes, ceresin waxes, petrolatum waxes, petroleum waxes, synthetic waxes, Fischer-Tropsch waxes, acrylate waxes, fatty acid amide waxes, silicone waxes, polytetrafluoroethylene waxes, alkylene waxes, polyethylene waxes, polypropylene waxes, and mixtures thereof.

4. The toner composition according to claim 1, wherein the toner particles have a total wax content of from about 0.01 percent by weight to about 9 percent by weight.

5. The toner composition according claim 1, wherein the toner particles further comprise one or more colorants chosen from the group consisting of pigments, dyes, and mixtures thereof.

6. The toner composition according to claim 1, wherein said mixing is performed in the presence of one or more coagulant chosen from the group consisting of polyaluminum halides, polyaluminum sulfosilicates, water soluble metal salts and mixtures thereof.

7. An emulsion aggregation process for preparing toner particles, the emulsion aggregation process comprising:

(i) providing one or more aqueous dispersions, the aqueous dispersions comprising particles including particles of one or more resins;

(ii) mixing the aqueous dispersions in presence of one or more coagulant;

(iii) adding one or more wax emulsions to the aqueous dispersions;

(iv) aggregating to form aggregated particles;

(v) adding one or more aqueous dispersions, which comprise particles including particles of one or more resins, to provide a coating over the aggregated particles to form toner size particles;

(vi) coalescing the toner size particles to form fused particles; and (vii) removing the fused particles from the aqueous dispersion;

wherein said adding one or more wax emulsions is performed after said mixing;

the fused particles have an average particle diameter of from about 1 to about 15 microns, with a particle geometric size distribution of less than about 1.3; and wherein the waxes are excluded from an interior core of the toner particles.

8. The process according to claim 7, wherein said mixing includes homogenizing.

9. The process according to claim 7, wherein said aggregating includes heating the aqueous dispersion.

10. The process according to claim 9, wherein said heating comprises a first heating below a glass transition temperature of the resin and a second heating above the glass transition temperature of the resin.

11. The process according to claim 7, further comprising raising pH of the aggregated particle dispersion after said adding one or more aqueous dispersions to freeze toner particle size.

12. The process according to claim 7, wherein said coalescing comprises lowering pH of the aggregated particle dispersion.

13. The process according to claim 7, wherein the resins are chosen from the group consisting of styrene, butadiene, acrylates, isoprene, methacrylates, acrylonitrile, acrylic acid, methacrylic acid, beta carboxylethyl acrylate (β-CEA), polyesters, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid); poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly (styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly(styrene-butadiene), poly(styrene-isoprene), poly (styrene-butyl methacrylate), poly(styrene-butyl acrylate-acrylic acid), poly(styrene-butyl methacrylate-acrylic acid), poly(butyl methacrylate-butyl acrylate), poly(butyl methacrylate-acrylic acid), poly(acrylonitrile-butyl acrylate-acrylic acid), and mixtures thereof.

14. The process according to claim 7, wherein the waxes are one or more wax chosen from the group consisting of natural vegetable waxes, carnauba waxes, candelilla waxes, Japan waxes, bayberry waxes, natural animal waxes, beeswax, punic waxes, lanolin, lac waxes, shellac waxes, spermaceti waxes, mineral waxes, paraffin waxes, microcrystalline waxes, montan waxes, ozokerite waxes, ceresin waxes, petrolatum waxes, petroleum waxes, synthetic waxes, Fischer-Tropsch waxes, acrylate waxes, fatty acid amide waxes, silicone waxes, polytetrafluoroethylene waxes, alkylene waxes, polyethylene waxes, polypropylene waxes, and mixtures thereof.

15. The process according to claim 7, wherein the toner particles have a total wax content of from about 0.01 percent by weight to about 9 percent by weight.

16. The process according to claim 7, wherein said providing further comprises providing one or more aqueous dispersions that comprise one or more colorants chosen from the group consisting of pigments, dyes, and mixtures thereof.

17. The process according to claim 7, wherein said mixing is performed in the presence of one or more coagulant chosen from the group consisting of polyaluminum halides, polyaluminum sulfosilicates, water soluble metal salts and mixtures thereof.

18. A process for preparing toner particles, the process comprising:

(i) providing one or more aqueous dispersions, the aqueous dispersions comprising particles including particles of one or more resins;

(ii) mixing the aqueous dispersions in presence of one or more coagulant;

(iii) aggregating to form core particles;

(iv) adding one or more aqueous dispersions, which comprise one or more wax and one or more resins, to provide a coating of wax and resin over the core particles to form coated particles;

(v) aggregating the coated particles to form toner size particles;

(vi) coalescing the toner size particles to form fused particles;

(vii) removing the fused particles from the aqueous dispersion; and wherein the fused particles have an average particle diameter of from about 1 to about 15 microns with a particle geometric size distribution of less than about 1.3.

19. The process according to claim 18, wherein the toner particles have a total wax content of from about 0.01 percent by weight to about 9 percent by weight.

20. The process according to claim 18, wherein said providing one or more aqueous dispersions further comprises providing one or more aqueous dispersions that comprise one or more colorants chosen from the group consisting of pigments, dyes, and mixtures thereof.

21. The process according to claim 18, wherein said aggregating includes heating the aqueous dispersion.

22. The process according to claim 21, wherein the heating comprises a first heating below a glass transition temperature of the resin and a second heating above the glass transition temperature of the resin.

23. The process according to claim 18, further comprising raising pH of the aggregated particle dispersion after said adding one or more aqueous dispersions, to freeze toner particle size.

24. The process according to claim 18, wherein coalescing comprises lowering pH of the aggregated particle dispersion.

25. The process according to claim 18, wherein the wax emulsion comprising a wax having a particle diameter of about 100 to about 500 nanometers, water, and a surfactant.

* * * * *